United States Patent [19]

Love, III

[11] Patent Number: 5,033,143

[45] Date of Patent: Jul. 23, 1991

[54] METHOD AND APPARATUS FOR INTERRUPTING FLUID STREAMS

[75] Inventor: Franklin S. Love, III, Columbus, N.C.

[73] Assignee: Milliken Research Corporation, Spartanburg, S.C.

[21] Appl. No.: 482,340

[22] Filed: Feb. 20, 1990

[51] Int. Cl.[5] ..... D06B 1/02; B05B 17/04

[52] U.S. Cl. ..... 8/158; 239/99; 239/434; 68/205 R

[58] Field of Search ..... 8/158; 68/205 R; 118/130; 239/99, 434, 569

[56] References Cited

U.S. PATENT DOCUMENTS

| | | | |
|---|---|---|---|
| 2,428,284 | 9/1947 | Krogel | 118/325 |
| 4,708,288 | 11/1987 | von Eckardstein | 239/434 |
| 4,747,541 | 5/1988 | Morine et al. | 68/205 R |
| 4,783,977 | 11/1988 | Gilpatrick | 68/205 R |
| 4,815,665 | 3/1989 | Haruch | 239/434 |
| 4,828,174 | 5/1989 | Love, III | 68/205 R |

*Primary Examiner*—William A. Cuchlinski, Jr.
*Assistant Examiner*—G. Bradley Bennett
*Attorney, Agent, or Firm*—Kevin M. Kercher; H. William Petry

[57] ABSTRACT

A method and apparatus for forming and selectively interrupting one or more fluid stream which is confined within an open channel. A transverse fluid stream is introduced into the channel at a point under the stream flowing within the channel. Introduction of the transverse stream at relatively low pressure is sufficient to cause the stream within the channel to leave the confines of the channel. If the channel is directed at a target, the method and apparatus will allow intermittent and selective interruption of a fluid stream flowing within the channel and directed at the target. The source of the transverse fluid stream has an arcuate or curved outlet portion to prevent fluid from the open channel from accumulating therein.

15 Claims, 3 Drawing Sheets

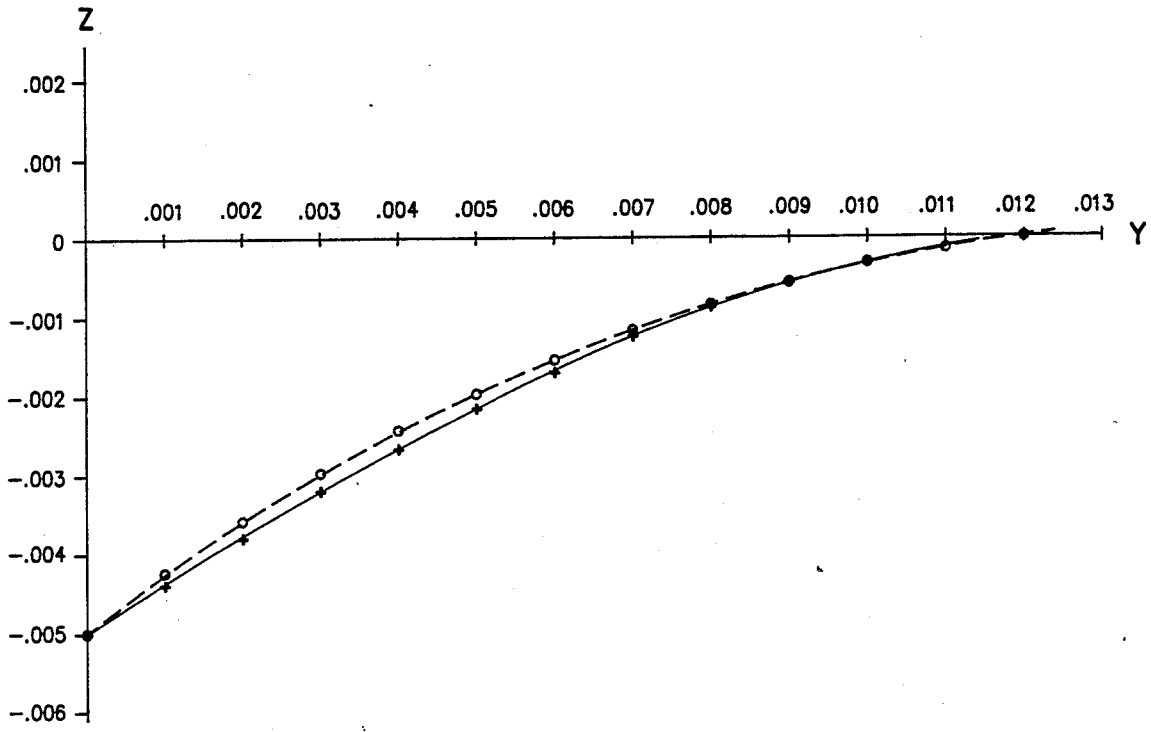
o ACTUAL
+ PREDICTED FROM SIN FUNCTION
*FIG. —6—*

METHOD AND APPARATUS FOR INTERRUPTING FLUID STREAMS

This invention relates to a method and apparatus for forming one or more fluid streams having relatively small, well defined cross sectional areas, and for interrupting, selectively and repeatedly, the flow of such streams in response to an externally supplied signal. More specifically, this invention relates to a method and apparatus which may be used to form and pulse the flow of one or more such fluid streams wherein the fluid streams must be directed onto a target or substrate with a precision on the order of 0.010 inch, and wherein the streams are being formed with fluid at pressures up to or exceeding 3000 p.s.i.g. The invention disclosed herein is suitable for use with both gases and liquids, at a variety of pressures, but is particularly well suited for applications wherein a liquid is to be formed and controlled. In particular, the teachings of this invention are especially well suited to applications wherein (1) fine liquid streams are formed having precisely defined cross sections, (2) such streams must be directed at a target with a high degree of accuracy and precision, and (3) such streams must be repeatedly and selectively interrupted and re-established, possibly over irregular or extended time intervals, with an extremely fast "on-off-on" response characteristic, in accordance with electronically defined and varied commands, and with relatively small expenditures of switching energy.

It is believed the teachings of this invention may be used advantageously in a wide variety of practical applications where fine streams of fluid are formed and/or applied to a target in a non-continuous manner, and where the streams are desirably interruptible in accordance with computer-supplied commands or data. Such applications are disclosed, for example, in U.S. Pat. No. 3,443,878 to Weber, et al., as well as U.S. Pat. No. 3,942,343 to Klein. These processes relate to the projection of several liquid streams of dye onto a textile substrate, and diverting one or more of the stream from a path leading to the substrate into a sump in accordance with externally supplied pattern information. It is believed that the teachings of this invention could improve significantly the degree of definition achievable with these systems as disclosed, as well as improve the deflection energy efficiency and perhaps improve the extent of dye penetration or degree of visual contrast achieved with such systems.

It is also believed that the method and apparatus of this invention may be used in the field of graphic arts for the purpose of controlling a fine stream of ink and selectively projecting the stream onto a paper target in accordance with electronically generated text or graphic commands.

Yet another potential application for the teachings of the instant invention is suggested by the various U.S. patents, e.g., U.S. Pat. Nos. 3,403,862, 3,458,905, 3,494,821, 3,560,326, and 4,190,695, dealing with the treatment or manufacture of non-woven textile substrates using high velocity streams of water.

It is believed these and related processes may be made more versatile and more efficient by incorporation of the teachings of the instant invention, whereby patterning is made electronically definable and variable, and whereby the substrates may be patterned with an extremely high degree of precision and accuracy, through use of a relatively low pressure control stream of fluid which is used to disrupt the flow of the fluid to be controlled as the latter fluid flows within an open channel. The method and apparatus of the invention disclosed herein permits the establishment, interruption, and re-establishment of one or more precisely defined fluid streams without many of the problems or disadvantages of methods and apparatus of the prior art. Among the advantages associated with the instant invention are the following:

(1) the apparatus of this invention can generate an array of extremely fine streams of fluid which are very closely spaced (i.e., twenty or more streams per linear inch), making possible extremely fine gauge patterning or printing;

(2) the apparatus of this invention uses no moving parts other than a valve used to control a relatively low pressure fluid stream; therefore, machine wear, failures due to metal fatigue, etc. are essentially eliminated;

(3) the apparatus of this invention exhibits extremely fast switching speeds (i.e., the fluid stream may be interrupted and re-established with negligible lag time and for periods of extremely short duration), and may be switched and maintained in one or another switched states with relatively little power consumption;

(4) the apparatus of this invention allows precise placement of the fluid streams onto a target, due to the fact that the stream cross-section is substantially maintained even while the stream is passing through the stream interruption portion of the apparatus; and (5) the apparatus designed in accordance with the teachings of this invention offers simplicity of fabrication, as well as ease of cleaning and maintenance, without the danger of damaging delicate parts, the inconvenience of reaming individual stream forming orifices, etc.

Further features and advantages of the invention disclosed herein will become apparent from a reading of the detailed description hereinbelow and inspection of the accompanying Figures, in which:

FIG. 6 is a graphic representation of air groove rounded corner.

FIGS. 1 through 5 depict an apparatus, embodying the instant invention, which may be used for the purpose of forming and interrupting the flow of a fluid stream in an open channel. This apparatus may, if desired, be used to interrupt intermittently the flow of a high pressure liquid stream, but is by no means limited to such application. Low pressure liquid streams, as well as gas streams at various velocities, may be selectively interrupted using the teachings herein. For purposes of the discussion which follows, however, it will be assumed that the fluid stream flowing in the channel is a liquid at relatively high velocity.

Figure 1:
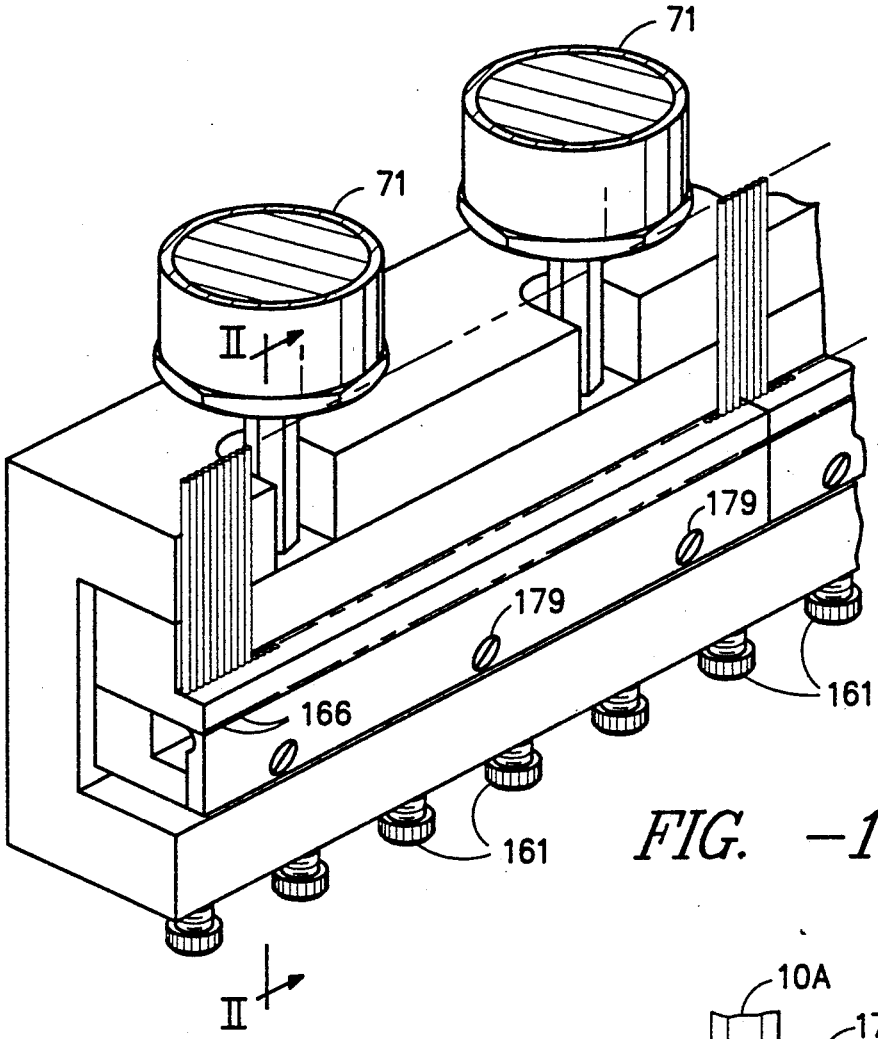
FIG. 1 is a perspective view of an apparatus embodying the instant invention wherein a transverse stream of a control fluid is used to interrupt the fluid streams confined in channels or grooves 166.
Figure 2:
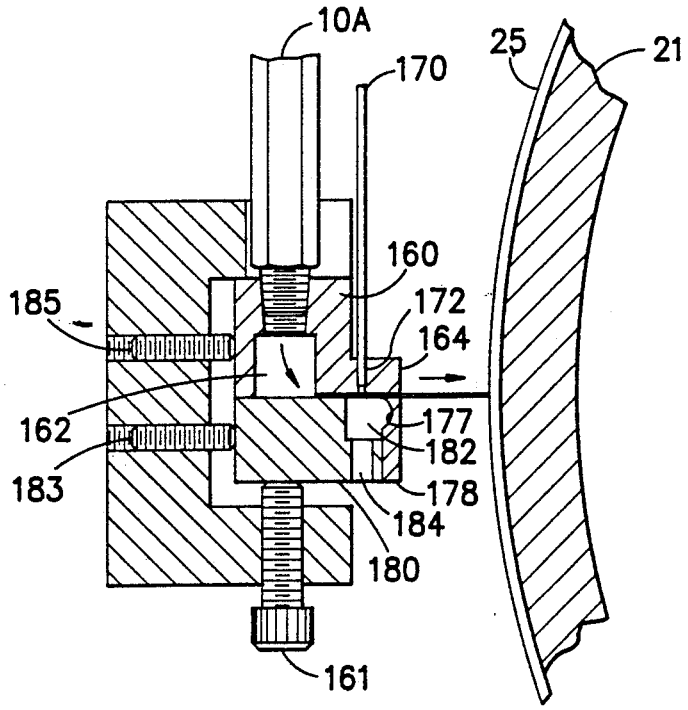
FIG. 2 is a section view taking along lines II—II of FIG. 1 and depicts the apparatus wherein a fluid stream is directed at a textile substrate.

As seen in the section view of FIG. 2, a conduit 10A supplies, via filter 71 (FIG. 1), a high pressure working fluid to manifold cavity 162 formed within inlet manifold block 160. Flange 164 is formed along one side of manifold block 160; into the base of flange 164 is cut a uniformly spaced series of parallel channels or grooves 166. Each groove 166 extends from cavity 162 to the forward-most edge of flange 164 and has cross-sectional dimensions corresponding to the desired cross-sectional dimensions of the stream. Thus, for example, the groove may have a cross-section resembling the letter "U", or may have a totally arbitrary shape. Control tubes 170, through which streams of relatively low pressure air or other control fluid are passed on command, are arranged in one-to-one relationship with grooves 166, and are, in one embodiment, positioned substantially in alignment with and perpendicular to grooves 166 by means of a series of sockets or wells 172 in flange 164, each of which are placed in direct vertical alignment with a respective groove 166 in flange 164, and into which each tube 170 is securely fastened. The floor of each socket 172 has a small passage 174 which in turn communicates directly with the base of its respective groove 166.

Positioned opposite inlet manifold block 160 and securely abutted thereto via bolts 161 are outlet manifold block 180 and optional containment plate 178. Containment plate 178 may be attached to outlet manifold block 180 by means of screws 179 or other suitable means. Within outlet manifold block 180 is machined optional discharge cavity 182 and outlet drain 184. Discharge cavity 182 and outlet drain 184 may extend across several grooves 166 in flange 164, or individual cavities and outlets for each groove 166 may be provided. It is preferred, however, that cavity 182 be positioned so that passage 174 leads directly into cavity 182, and not led into the upper surface of outlet manifold block 180 or containment plate 178. Discharge cavity 182 includes impact cavity 177 which is machined into containment plate 178. Bolts 183 and 185 provide adjustment of the relative alignment between inlet manifold block 160 and the combination of outlet manifold block 180 and containment plate 178.

In operation, a working fluid is fed into inlet cavity 162, where it is forced to flow through a first enclosed passage, formed by grooves 166 in flange 164 and the face of outlet manifold block 180 opposite flange 164, thereby forming the fluid into discrete streams having the desired cross-sectional shape and area. The preformed streams may be positioned within grooves 166 so that reduced or substantially no contact between the streams and the floor or base of grooves 166 occurs, and that substantially all contact between the streams and the grooves takes place at the groove walls, which walls thereby define the lateral boundaries of the streams.

It has been discovered that, so long as control tubes 170 remain inactivated, i.e., so long as no control fluid from tubes 170 is allowed to intrude into grooves 166 at any significant pressure, the streams of working fluid may be made to traverse the width of discharge cavity 182 in an open channel formed only by grooves 166 without a significant loss in the coherency or change in the cross-sectional shape or size of the stream, although under certain conditions, some slight spreading of the stream in a direction parallel to the groove walls and normal to the groove floor may occur. After traversing the width of discharge cavity 182, the streams encounter the edge of optional containment plate 178, whereupon the streams are made to flow in a second completely enclosed passage, formed by grooves 166 in flange 164 and the upper end of containment plate 178, just prior to being ejected in the direction of the desired target 25, e.g., a textile substrate. Where precise stream definition is necessary, e.g., in the direction of the open portion of grooves 166, use of containment plate 178 or similar structure is preferred. The ability to define the streams cross-section at extremely close distances to the target, which occurs even without the use of plate 178 as a consequence of the stream flowing uninterruptedly in grooves 166, serves to minimize any stream placement inaccuracies due to slight non-parallelism in adjacent grooves 166 or problems resulting from the presence of nicks or burrs in the grooves. It is considered an advantageous feature of this invention that passing said stream through a second enclosed passage, and thereby allowing re-definition of the stream cross-section about the entire stream cross-section perimeter, may be achieved without the stream having to leave grooves 166.

Figure 3:
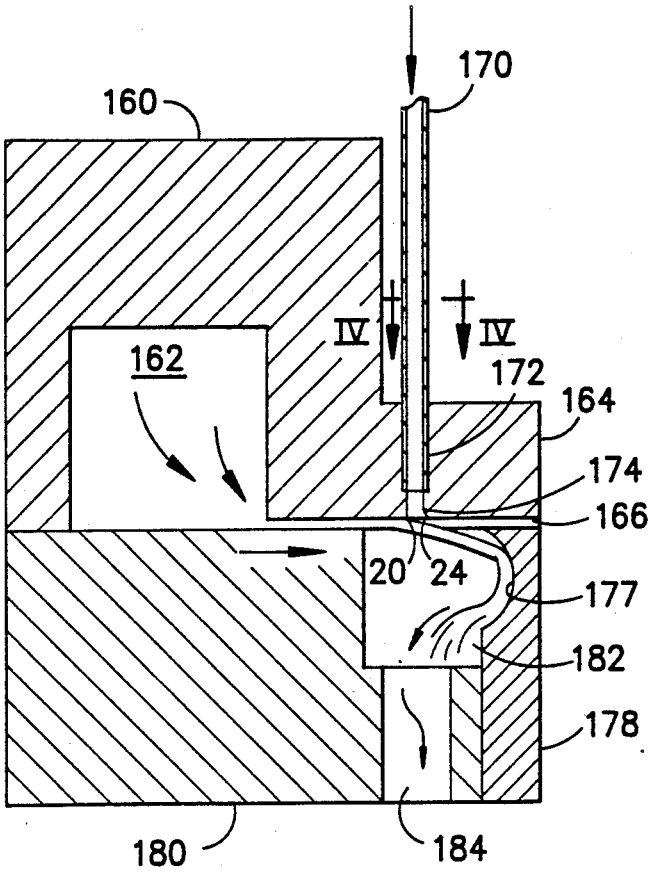
FIG. 3 is an enlarged section view of the inlet and discharge cavity portion of the apparatus of FIG. 2, showing the effects of energizing the control stream.
Figure 4:
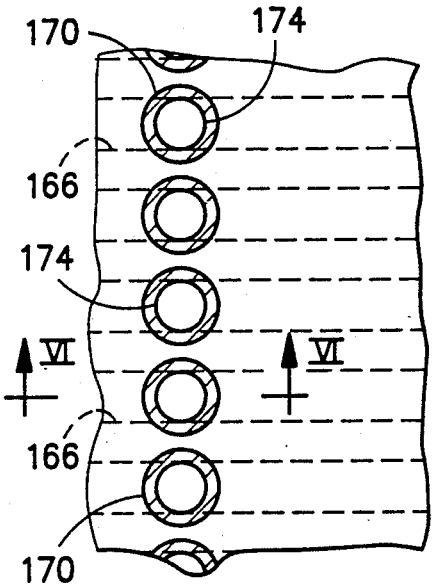
FIG. 4 is a section view taken along lines IV—IV of FIG. 3.
Figure 5:
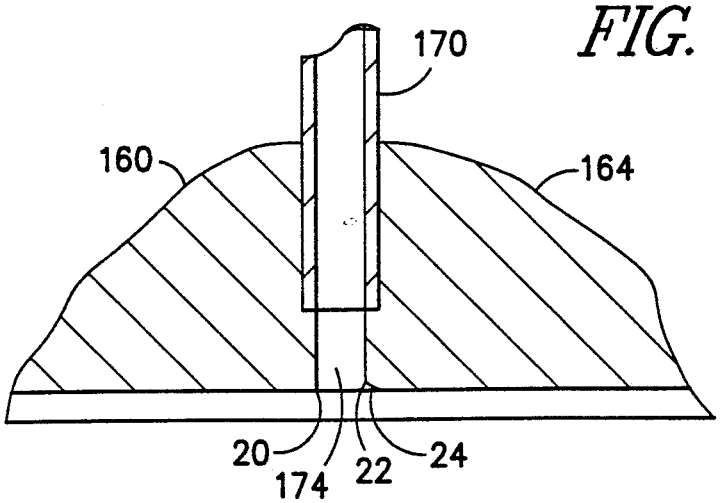
FIG. 5 is a blown-up view of the grooves shown in FIGS. 2 and 3.

To interrupt the flow of working fluid which exits from grooves 166 in the direction of the desired target 25, it is necessary only to direct a relatively small quantity of relatively low pressure air or other control fluid, through the individual control tubes 170, into the associated grooves 166 in which flow is to be interrupted and under the working fluid stream. For purposes herein, the term "under" as used in this context shall mean a position between the working fluid stream within the groove and the base of the groove. As depicted in FIG. 3, the control fluid, even though it may be at a vastly lower pressure (e.g., one twentieth or less) than the working fluid, is able to lift and divert the working fluid stream defined by the walls of groove 166 and can cause instabilities in the stream which, for example, where the working fluid is a relatively high velocity liquid, may lead to virtual disintegration of the working fluid stream. While, for diagrammatic convenience, FIG. 3 indicates a liquid stream which is merely lifted from the groove and deflected into the curved containment cavity 177 of containment plate 178, in fact a high velocity liquid stream is observed to be almost completely disintegrated by the intrusion of a relatively low pressure control fluid stream as soon as the liquid stream passes the point where the control fluid stream is introduced into the grooves and the working liquid stream begins to lift from the groove. It is believed containment cavity 177 and containment plate 178 serve principally to contain the energetic mist which results from such disintegration, and are not necessary in all applications. Likewise, if disposing of the interrupted fluid presents no problem, discharge cavity 182 need not be provided and the interrupted fluid may simply be allowed to drain or disperse in place.

The following Examples are intended to illustrate details of the instant invention and are not intended to be limiting in any way.

EXAMPLE

A multiple stream nozzle was fabricated as follows: a stainless steel bar six inches long and approximately one inch wide was slotted at 10 slots per inch for the full 6" length. The slots were 0.030" wide by 0.008" deep by 7/16" long, and extended to an edge of the bar. Centered on the slot length of one of the slots, one 0.028" hole is drilled; the depth of the hole was approximately 0.032". Also centered on the same slot, a 0.042" hole was drilled from the back side of the bar so as to communicate with the single 0.028" hole. A lead and gold plated flat clamping plate was used to seal the nozzle and cover approximately 0.125" of 7/16" groove length, and was positioned to be aligned with but not cover the hole. Screws were used to hold the clamping plate to the nozzle. A deflector plate was then placed about 0.065" beyond the 0.028" hole. To demonstrate the effectiveness of the apparatus, the nozzle was pressurized with water at a pressure of 1200 p.s.i.g. The flow rate from each of the jets was 0.41 gallons per minute. A 0.125" hole associated with a single slot was then connected to a source of pressurized air through a 24 volt Tomita Tom-Boy JC-300 electric air valve (manufactured by Tomita Co., Ltd., No. 18-16. 1 Chome, Ohmorinaka, Ohta-ku, Tokyo, Japan). The air pressure was set at 65 p.s.i.g. By opening the air valve, the water jet could be deflected out of the chosen slot and caused to disintegrate, thereby interrupting the flow of the high pressure water jet from the nozzle. Crisp control of the water stream was observed, with extremely fast response time in switching from "stream on" to "stream off" conditions, as well as vice versa.

In the operation of the apparatus described, it has been found that fluid in the grooves 166 tends to go up into passage 174 once it leaves the sharp edge 20 on the downstream side of the passage 174. This is a natural phenomenon since a stream of confined liquid fans out when freed from the constraining force. This fluid in the passage 174 creates numerous problems in the operation of the described apparatus. One problem is that the fluid in the passage 174 must be blown out when the air in the tubes is cut on resulting in a slower reaction time resulting in definition problems on the fabric 25 being treated. Also the fluid in the passage 174 tends to get into the air valves and in time results in defective valve action. Furthermore, the fluid in the passage 174 can cause a back pressure which will cause the air hoses to be blown off when water is supplied.

Whenever a fluid expands or fans out it does so at an angle which can be determined so that the impingement point 22 on the downstream side of the passage 174 can be calculated. Since the impingement point 22 is known, the downstream edge 24 of the hole or passage 174 is curved downward to a point tangential to the upper surface of the groove 166 so that the fluid will be guided into and through the position of the passage 166 downstream of the passage 174 rather than backing up into same.

By experimentation and tesing, it has been found that when the convex or curved edge 24 of the passage approaches a sine curve, maximum return without reflection of the fanned out fluid into the passage 166 occurs. This curve is defined by the equation:

$$Z = -l + l \sin\left(\frac{\pi y}{2m}\right)$$

where z=vertical axis y=horizontal axis l=vertical distance from the centerline of the groove to the impingement point 22 m=horizontal distance between the impingement point 22 to tangent point of the curve In the preferred form of the invention l=0.005 and m=0.013 resulting in the curve shown in FIG. 6 which is the shape of the curve 24 to provide maximum efficiency. It has been found that the curve 24 provides maximum return without reflection of the fanned fluid stream into the groove 166 to virtually eliminate the collection of fluid in the passage 174, thereby preventing backing up of fluid into the air tubes 170.

I claim:

1. A method for intermittently interrupting the flow of a first fluid stream within an open channel, which stream at least partially conforms to and is laterally confined within said open channel, thereby defining the lateral boundaries of said stream, by means of a transverse stream of a second fluid, said method comprising directing from a source a transverse stream of a second fluid into said first fluid stream with sufficient pressure to force said first fluid stream to leave the confines of said channel and redirecting a portion of the first fluid from the source of the second fluid when there is no second pressured fluid in the source, wherein the redirected first fluid is directed along an arcuate surface.

2. The method of claim 1 wherein said first fluid stream substantially conforms to said open channel, is flowing within said channel at relatively high velocity, and wherein said transverse stream has sufficient pressure to disrupt the flow of said first fluid stream and cause said first fluid stream to dissipate.

3. The method of claim 1 wherein said first fluid stream is a liquid stream and said second fluid is a gas.

4. The method of claim 1 wherein said first fluid stream flowing within said open channel is directed at a textile substrate.

5. An apparatus for intermittently interrupting the flow of a first fluid stream within an open channel, which stream at least partially conforms to and is laterally confined within said open channel, thereby laterally restricting said stream to the confines of said channel, by means of a transverse stream of a second fluid, said means comprising:

a. means for supplying a stream of said first fluid in alignment with said channel;

b. means for directing a transverse stream of said second fluid into said first fluid stream; and c. fluid supply means for supplying said second fluid to said directing means at a sufficient pressure to cause said first fluid stream to leave the confines of said channel, said means for directing a transverse stream of said fluid including a passage in communication with said channel, said passage having an arcuate-shaped outlet into said channel downstream from the means to supply said first fluid to redirect portions of said first fluid therein back to said channel.

6. The apparatus of claim 5 wherein said means for supplying a stream of said first fluid in alignment with said channel includes a first fluid forming aperture which is aligned with said open channel and which has a substantially similar cross-section, said aperture being in fluid communication with a source of said first fluid.

7. The apparatus of claim 5 wherein said arcuate-shaped outlet is substantially a portion of a sine wave.

8. The apparatus of claim 7 wherein said arcuate-shaped outlet position is defined by the equation:

$$Z = -l + l \sin\left(\frac{\pi y}{2m}\right)$$

9. The apparatus of claim 7 which further comprises a stream forming means for giving said first fluid stream a desired cross-section following the flow of said fluid stream within said open channel, said stream forming means including an aperture in substantial alignment with said channel.

10. The apparatus of claim 7 wherein said first fluid forming aperture and said open channel are comprised of a common slot which extends from said first fluid forming aperture to said open channel without substantial interruption.

11. The apparatus of claim 7 which further comprises a stream forming means for giving said first fluid stream a desired cross-section following the flow of said fluid stream within said open channel, said stream forming means including an aperture in substantial alignment with said channel, and wherein said first fluid forming aperture, said open channel, and said stream forming means are comprised of a common slot which extends from said first fluid forming aperture to said open channel to said stream forming means without substantial interruption.

12. The apparatus of claim 7 which further comprises containment means for containing said first fluid stream after said stream is caused to leave the confines of said channel, said containment means comprising a cavity means located across the path of said first fluid stream in said channel, said cavity means being positioned in close proximity to, and directly opposite said open channel to permit said directing means to direct said first liquid stream into said cavity means from said open channel.

13. Apparatus to apply selective streams of a fluid onto a substrate comprising: a first conduit means, having an inlet and an outlet, to supply a first fluid under pressure onto a substrate, a second conduit means operable associated with said first means to supply a fluid under pressure against the first fluid under pressure at predetermined times to direct the first fluid away from the substrate and means to periodically supply the second fluid against the first fluid, said second conduit means having a sharp portion adjacent said first conduit means and an arcuate portion adjacent said first conduit means, wherein said sharp portion is in closer proximity to said inlet than said outlet and said arcuate portion is in closer proximity to said outlet than said inlet.

14. The apparatus of claim 13 wherein said arcuate portion is substantially the shape of a sine wave.

15. The apparatus of claim 14 wherein the arcuate portion is defined by the equation:

$$Z = -l + l \sin\left(\frac{\pi y}{2m}\right)$$

* * * * *